US011762320B2

(12) United States Patent
Suzuki et al.

(10) Patent No.: US 11,762,320 B2
(45) Date of Patent: Sep. 19, 2023

(54) IMAGE FORMING APPARATUS

(71) Applicant: FUJIFILM Business Innovation Corp., Tokyo (JP)

(72) Inventors: Hiroyuki Suzuki, Kanagawa (JP); Naohito Otsuki, Kanagawa (JP); Takehiko Koizumi, Kanagawa (JP); Yuta Chino, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/540,241

(22) Filed: Dec. 2, 2021

(65) Prior Publication Data

US 2023/0061963 A1 Mar. 2, 2023

(30) Foreign Application Priority Data

Aug. 25, 2021 (JP) ..... 2021-137594

(51) Int. Cl.
*G03G 15/00* (2006.01)
*G03G 15/16* (2006.01)
(Continued)

(52) U.S. Cl.
CPC ..... *G03G 15/6529* (2013.01); *G03G 15/0131* (2013.01); *G03G 15/167* (2013.01);
(Continued)

(58) Field of Classification Search
CPC ..... G03G 15/0131; G03G 15/1615; G03G 15/6564; G03G 15/5058; G03G 15/167;
(Continued)

(56) References Cited

U.S. PATENT DOCUMENTS 5,075,734 A * 12/1991 Durland ..... B65H 29/042 399/301
6,637,328 B1 * 10/2003 Berrigan ..... B41J 11/0085 83/40

(Continued)

FOREIGN PATENT DOCUMENTS

| | | |
|---|---|---|
| EP | 3466852 | 4/2019 |
| JP | S597966 | 1/1984 |
| JP | 3718536 | 11/2005 |

OTHER PUBLICATIONS

"Search Report of Europe Counterpart Application", dated Dec. 13, 2022, p. 1-p. 8.

(Continued)

*Primary Examiner* — Jessica L Eley
(74) *Attorney, Agent, or Firm* — JCIPRNET

(57) ABSTRACT

An image forming apparatus includes: a circulating member that is a part of a transport path that transports a recording medium; a holding member that is fixed to the circulating member, circulates, and holds a leading end portion of the recording medium; an image forming section that forms an image on the recording medium at an image forming position in a circulation path of the circulating member; and a feeding section that feeds out the recording medium to a holding position where the holding member holds the leading end portion of the recording medium. When a circulation velocity Vg is defined as a velocity at which the circulating member circulates the holding member, a transport velocity of the recording medium is reduced from a first transport velocity V1, which is higher than the circulation velocity Vg, to a second transport velocity V2, which is lower than the first transport velocity V1, before the leading end portion of the recording medium enters the holding position.

20 Claims, 14 Drawing Sheets

(51) Int. Cl.
*G03G 15/01* (2006.01)
*G03G 15/20* (2006.01)

(52) U.S. Cl.
CPC ..... *B65H 2301/4474* (2013.01); *B65H 2301/44712* (2013.01); *G03G 15/2028* (2013.01)

(58) Field of Classification Search
CPC ..... G03G 15/2028; G03G 15/1605; G03G 15/1665
See application file for complete search history.

(56) References Cited

U.S. PATENT DOCUMENTS

2006/0127135 A1* 6/2006 Umezawa ..... G03G 15/167 399/302
2010/0226676 A1* 9/2010 Funamoto ..... G03G 15/0194 399/302

OTHER PUBLICATIONS

"Office Action of Australia Counterpart Application", dated May 22, 2023, p. 1-p. 6.

* cited by examiner

IMAGE FORMING APPARATUS

CROSS-REFERENCE TO RELATED APPLICATIONS

This application is based on and claims priority under 35 USC 119 from Japanese Patent Application No. 2021-137594 filed Aug. 25, 2021.

BACKGROUND

(i) Technical Field

The present disclosure relates to an image forming apparatus.

(ii) Related Art

Japanese Unexamined Patent Application Publication No. 59-007966 discloses a technology related to a transfer-sheet transport device of a recording apparatus. The transfer-sheet transport device moves, at a constant velocity, a recording head including a light-emitting-element array and an image forming system that are arranged substantially in the generatrix direction of a photoconductor drum that rotates at a constant velocity; forms a latent image by helically scanning the photoconductor drum; and transfers, to a transfer sheet, a toner image that is obtained by developing the latent image. In this technology, the transfer-sheet transport device includes: a pair of endless chains or belts that are transported in a direction at right angles to the axial line of the photoconductor drum; a gripper unit whose two ends are respectively fixed to the pair of endless chains or belts and that grips a leading end portion of the transfer sheet and transports the transfer sheet; and a unit that variably controls the positional relationship between the pair of chains or belts in the transport direction. The transfer-sheet transport device transports the transfer sheet in an inclined state by inclining the direction of the gripper unit at an angle that is the same as the angle between the scanning direction of helical recording on the photoconductor and the drum circumferential direction before transporting the transfer sheet to the transfer position.

SUMMARY

It is not possible or it is difficult for a holding member to hold a recording medium if the transport velocity of the recording medium when a feeding section feeds out the recording medium is the same as the circulation velocity of the holding member that is circulating and if the recording medium enters a holding position without changing the transport velocity.

Aspects of non-limiting embodiments of the present disclosure relate to suppression of failure of the circulating holding member in holding a recording medium, compared with a case where the recording medium fed out from the feeding section enters the holding position without changing a constant transport velocity.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a circulating member that is a part of a transport path that transports a recording medium; a holding member that is fixed to the circulating member, circulates, and holds a leading end portion of the recording medium; an image forming section that forms an image on the recording medium at an image forming position in a circulation path of the circulating member; and a feeding section that feeds out the recording medium to a holding position where the holding member holds the leading end portion of the recording medium, wherein when a circulation velocity Vg is defined as a velocity at which the circulating member circulates the holding member, a transport velocity of the recording medium is reduced from a first transport velocity V1, which is higher than the circulation velocity Vg, to a second transport velocity V2, which is lower than the first transport velocity V1, before the leading end portion of the recording medium enters the holding position.

BRIEF DESCRIPTION OF THE DRAWINGS

Exemplary embodiments of the present disclosure will be described in detail based on the following figures, wherein.

DETAILED DESCRIPTION

Examples of an image forming apparatus according to exemplary embodiments of the present disclosure will be described.

First Exemplary Embodiment

Figure 1:
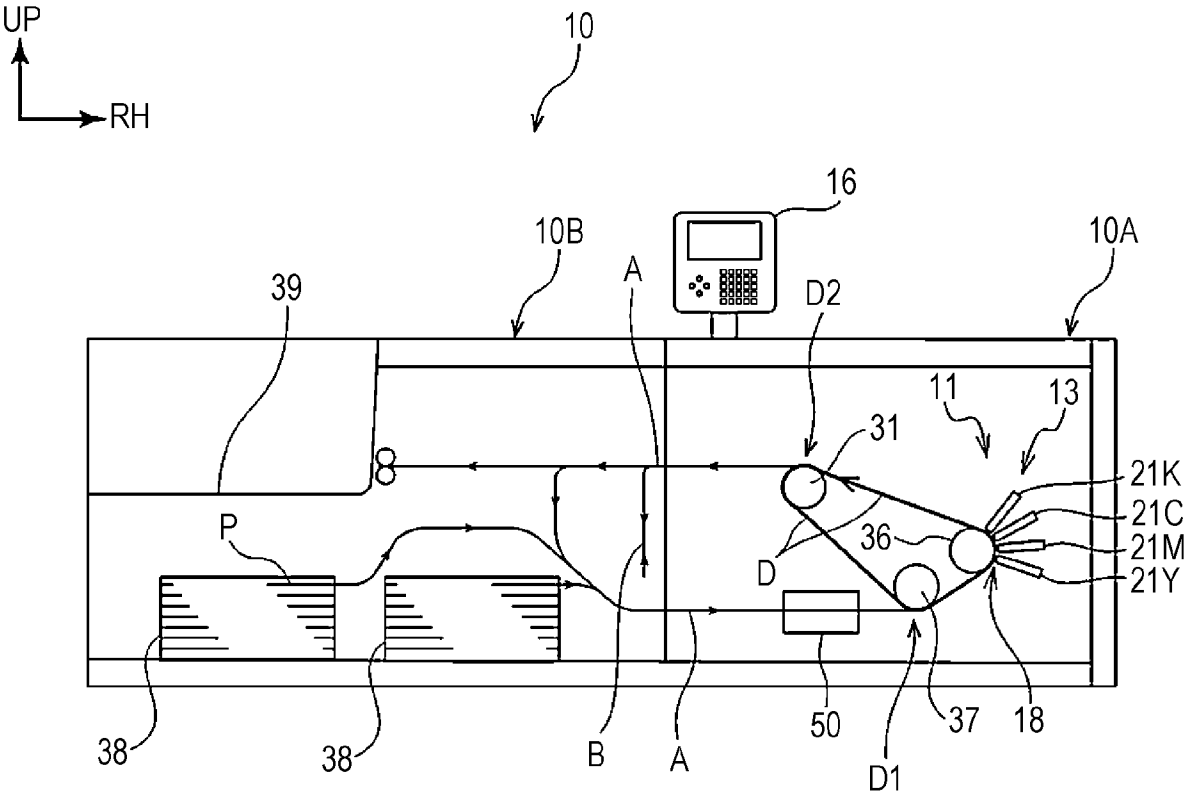
FIG. 1 is a front view illustrating an image forming apparatus according to a first exemplary embodiment.

Referring to FIGS. 1 to 10, an image forming apparatus according to a first exemplary embodiment of the present disclosure will be described. An arrow UP shown in each figure indicates a vertically upward direction of the apparatus. As illustrated in FIG. 1, an arrow RH indicates a horizontally rightward direction in the front view of the apparatus. In the following description, unless otherwise noted, "up-down direction" represents the up-down direction of the apparatus shown in FIG. 1. In the following description, unless otherwise noted, "left-right direction" represents the leftward (=L) and rightward (=R) directions in the front view of the apparatus shown in FIG. 1. In the following description, unless otherwise noted, "depth direction" (=front and back direction) represents the depth direction in the front view of the apparatus shown in FIG. 1.

Overall Structure of Image Forming Apparatus

First, the configuration of an image forming apparatus 10 will be described. FIG. 1 is a front view schematically illustrating the image forming apparatus 10 according to the present exemplary embodiment.

As illustrated in FIG. 1, the image forming apparatus 10 includes a unit 10A disposed on the right side in FIG. 1 and a unit 10B disposed on the left side in FIG. 1. The unit 10A, which is disposed on the right side in FIG. 1, includes an image forming section 11 that forms an image on a sheet P, which is an example of a recording medium.

The image forming section 11 includes a liquid-droplet ejecting mechanism 13 for forming an image by using an inkjet method. The liquid-droplet ejecting mechanism 13 includes liquid-droplet ejection heads 21Y, 21M, 21C, and 21K that eject droplets of black (K), yellow (Y), magenta (M), and cyan (C), which are examples of color ink droplets, toward the sheep P, which is an example of a recording medium.

The liquid-droplet ejection head 21Y, the liquid-droplet ejection head 21M, the liquid-droplet ejection head 21C, and the liquid-droplet ejection head 21K are arranged in this order from upstream to downstream in the transport direction (described below) of the sheet P. The liquid-droplet ejection head 21Y, the liquid-droplet ejection head 21M, the liquid-droplet ejection head 21C, and the liquid-droplet ejection head 21K are arranged so that ejection surfaces 23Y, 23M, 23C, and 23K face a transfer member 36 described below (see also FIG. 2). Color inks are supplied from ink tanks (not shown) to the liquid-droplet ejection heads 21Y, 21M, 21C, and 21K.

In the present exemplary embodiment, yellow (Y), magenta (M), cyan (C), and black (K) are basic colors for outputting a color image. In the following description, where it is not necessary to distinguish between the colors, "Y", "M", "C", and "K" attached to the reference numerals will be omitted, and the term "liquid-droplet ejection head 21" will be used.

The liquid-droplet ejection heads 21Y, 21M, 21C, and 21K for respective colors basically have the same structure, excluding the types of inks used. A method used by the liquid-droplet ejection head 21 to eject an ink droplet is not particularly limited. For example, a thermal method, a piezoelectric method, or the like may be used as a method of ejecting an ink droplet.

Figure 2:
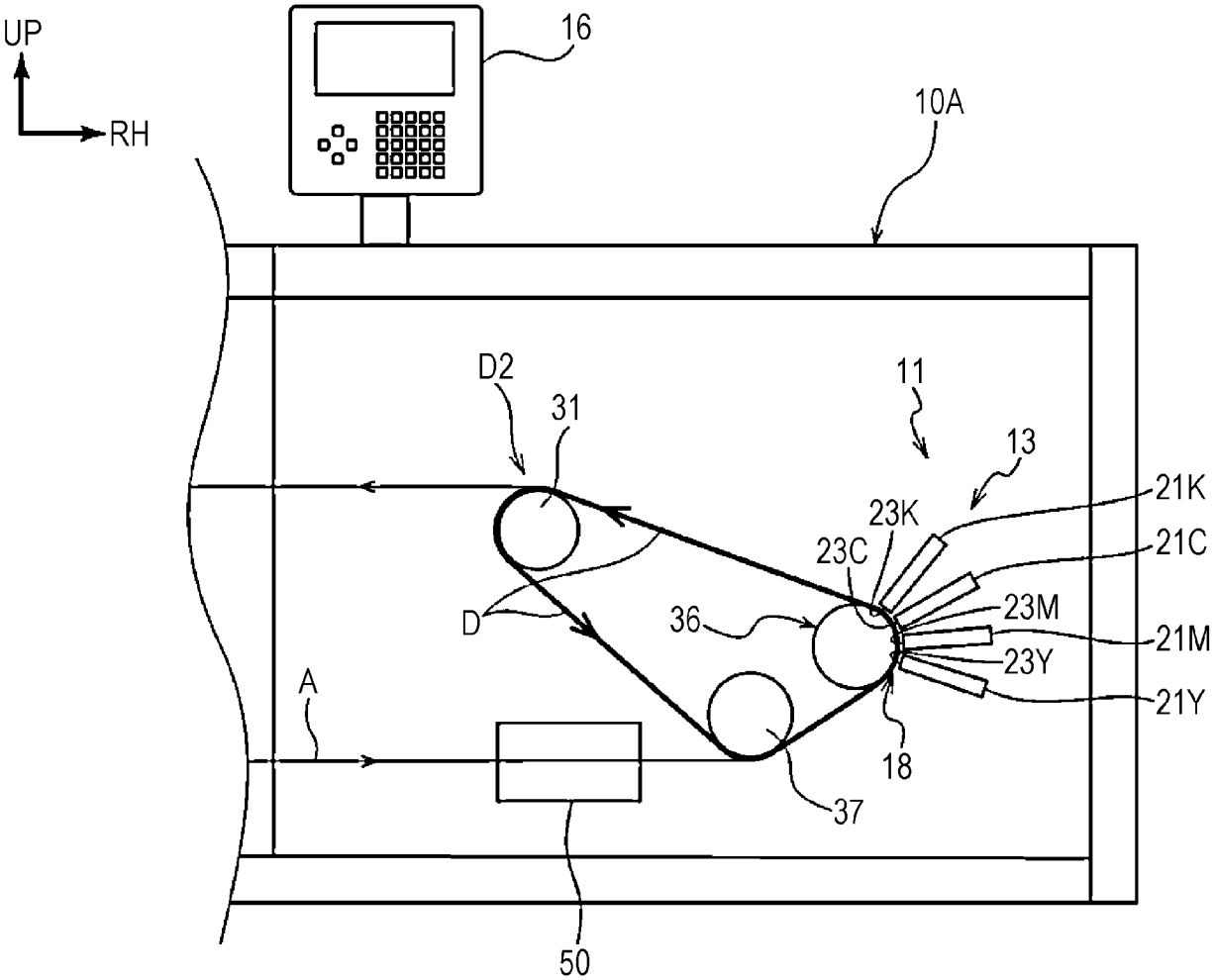
FIG. 2 is an enlarged view of a region around an image forming position of the image forming apparatus of FIG. 1.

As illustrated in FIG. 2, the liquid-droplet ejection heads 21Y, 21M, 21C, and 21K are each a full-line head that has a length corresponding to the width of an image recording region of the sheet P (see FIG. 1) and in which plural ink ejection nozzles (not shown) are arranged in the ejection surfaces 23Y, 23M, 23C, and 23K over the entire width of the image recording region. Each liquid-droplet ejection head 21 is immovably set to extend in a direction perpendicular to the transport direction of the sheet P (see FIG. 1).

In the present exemplary embodiment, an example in which an image is recorded by using four color inks of CMYK is described. However, the colors of inks and combinations of the colors are not limited to this example and may be changed. For example, as necessary, a light-color ink such as a light cyan ink or a light magenta ink, a thick-color ink, and a specific-color ink may be added. The order of arrangement of the heads for the colors is not limited to the order shown in the figures.

Transfer Member

Figure 7:
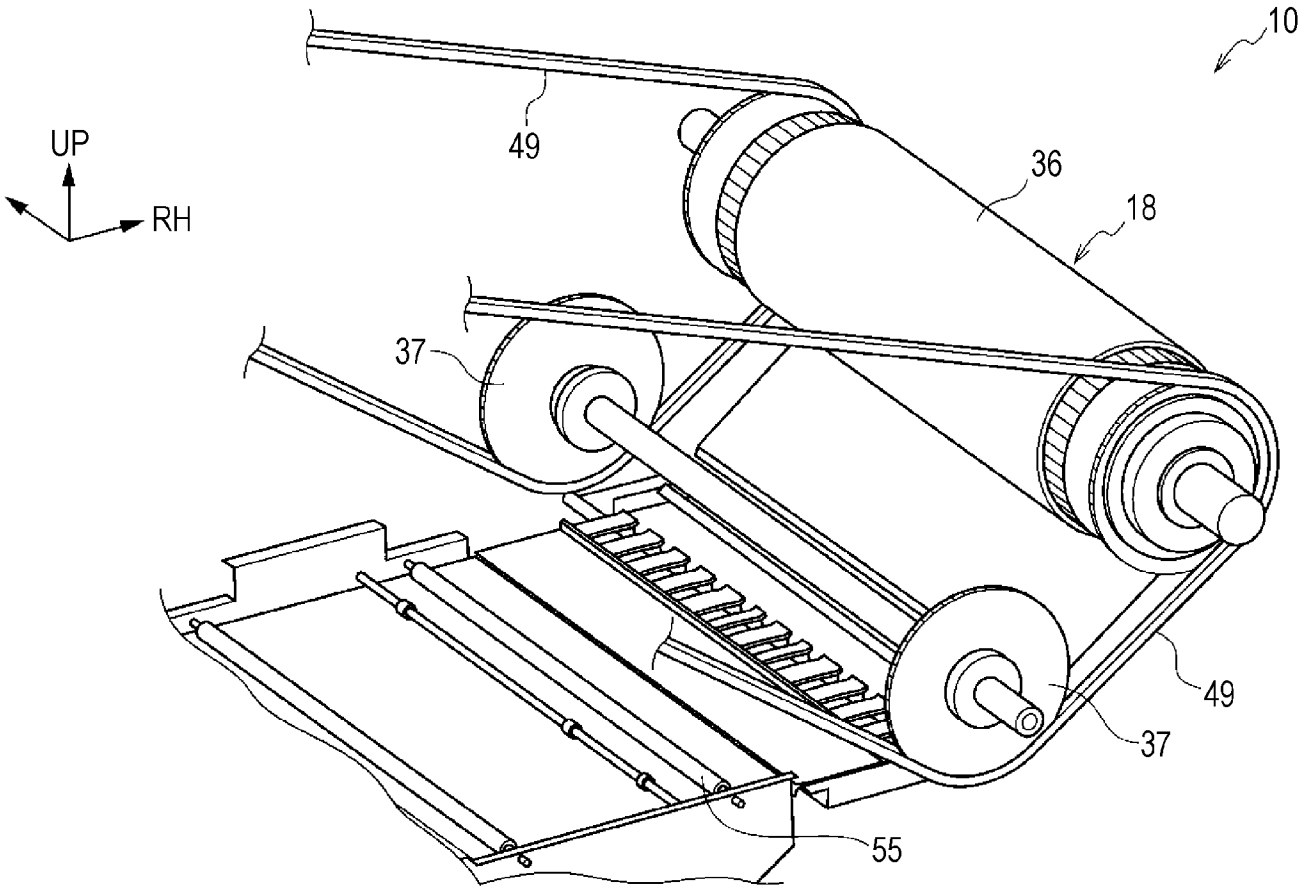
FIG. 7 is a perspective view illustrating the structure of a part of the image forming apparatus of FIG. 1.

As illustrated in FIGS. 1, 2, and 7, the image forming apparatus 10 includes the transfer member 36. The transfer member 36 has a cylindrical shape whose axial direction is the depth direction of the image forming apparatus 10, and is rotatable in the circumferential direction. In an outer periphery of the transfer member 36, a recess, in which a gripper 42 (described below) is to be accommodated, is formed. The transfer member 36 includes sprockets, around each of which a chain 49 (described below) is wrapped, at both end portions in the axial direction.

Image Forming Position

As illustrated in FIGS. 1 and 2, an image forming position 18 (see also FIG. 7) is a position where an image is formed by ejecting ink droplets to the sheet P from the ejection surface 23 (see FIG. 2) of each liquid-droplet ejection head 21 facing the transfer member 36.

Sheet Transport Path

As illustrated in FIG. 1, a sheet transport path A has a function of transporting the sheet P supplied from a sheet tray 38. The image forming apparatus 10 according to the present exemplary embodiment includes plural sheet trays 38. The sheet P, which is supplied from one of the sheet trays 38, is transported along the sheet transport path A. Then, the sheet P passes through the image forming position 18, and is output to a sheet output tray 39.

To be more specific, the sheet transport path A extends through the unit 10B, the unit 10A, and the unit 10B in order. Thus, the sheet P, which is transported along the sheet transport path A, is supplied from the sheet tray 38 disposed in the unit 10B, passes through the unit 10A, and is further returned to the unit 10B.

On the other hand, the sheet transport path A branches off at a position downstream of a receiving position D2 (described below) into a direction-changing path B for changing the transport direction of the sheet P. The direction-changing path B joins the sheet transport path A at a position further downstream in the transport direction. A part of the sheet transport path A between the direction-changing path B and a circulation path D is a joining path where a front-surface transport path of the sheet P and a back-surface transport path of the sheet P joins. The circulation path D will be described below. Each transport path includes plural sheet transport rollers (not shown). The sheet P is transported by the rollers along each transport path.

Image Forming Operation of forming Basic Image

Next, a basic image forming operation performed by the image forming apparatus 10 to form an image on the sheet P will be described.

Various actions in the image forming apparatus 10 are controlled by a controller 16 incorporated in the apparatus. When receiving an image forming command from the outside, the controller 16 activates the liquid-droplet ejecting mechanism 13 of the image forming section 11. The controller 16 sends image data, which has been generated by an image signal processor (not shown) by image processing, to the image forming section 11. Then, at the image forming position 18, the liquid-droplet ejection head 21 for each color ejects ink droplets to the sheet P to form an image on the sheet P.

When duplex printing is performed, the sheet P passes through the receiving position D2 (described below). Further, the transport direction of the sheet P is changed in the direction-changing path B provided in the transport path. Then, the sheet P is transported along a transport path C, which includes plural rollers (not shown), and is transported again to the sheet transport path A.

Gripper

Figure 3:
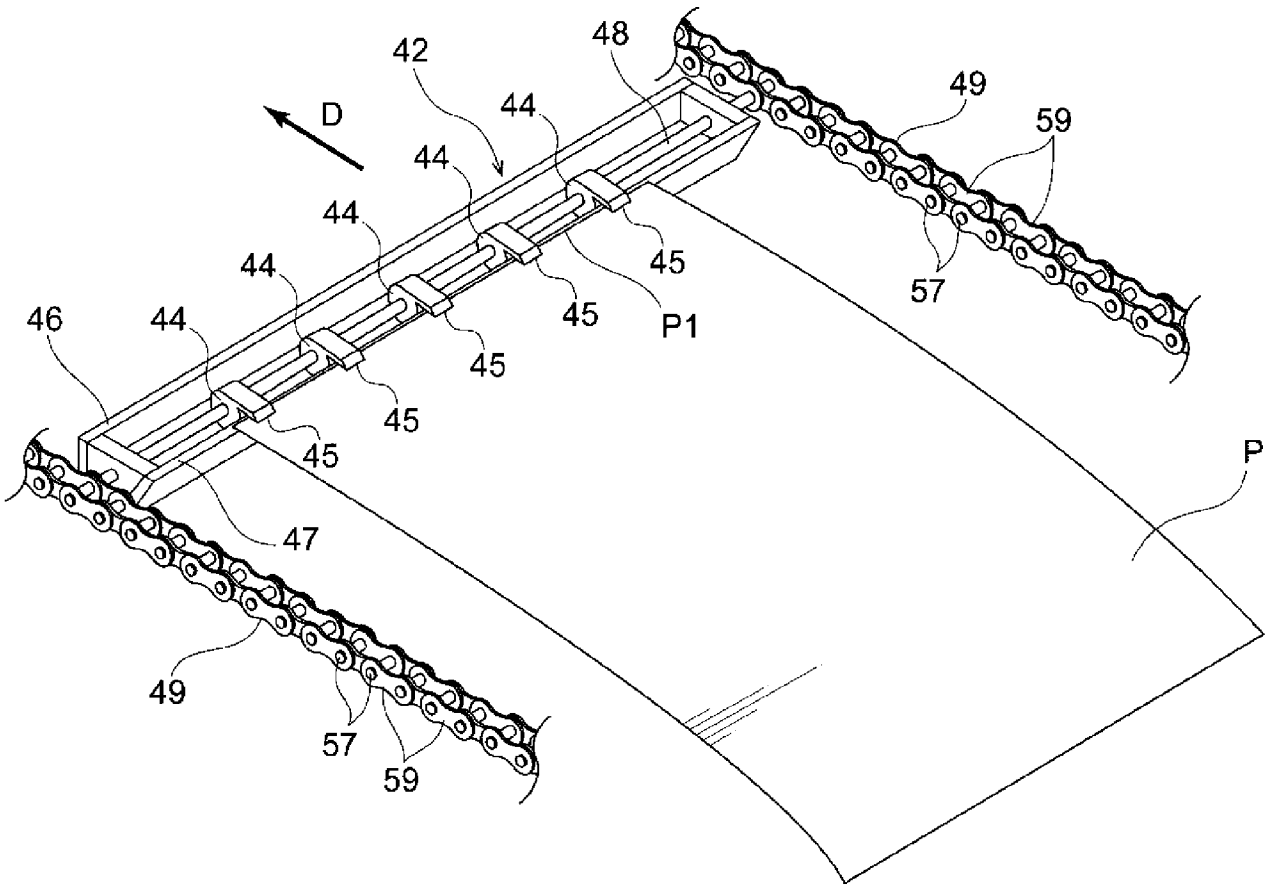
FIG. 3 is an enlarged view illustrating a state in which a gripper of the image forming apparatus of FIG. 1 is holding a sheet.

As illustrated in FIGS. 3 and 4, the image forming apparatus 10 includes the gripper 42 that holds a leading end portion P1 (see FIG. 3) of the sheet P, which is being transported, and that is an example of a holding member that assists in transportation of the sheet P. Plural clips 44 are arranged in the depth direction of the apparatus (see FIG. 3).

The gripper 42 includes the clips 44, a rectangular case 46 that covers the clips 44, and a shaft 48 that extends in the depth direction. The clips 44 are fixed to the shaft 48, and are rotatable in accordance with rotation of the shaft 48 in the circumferential direction.

Figure 4B:
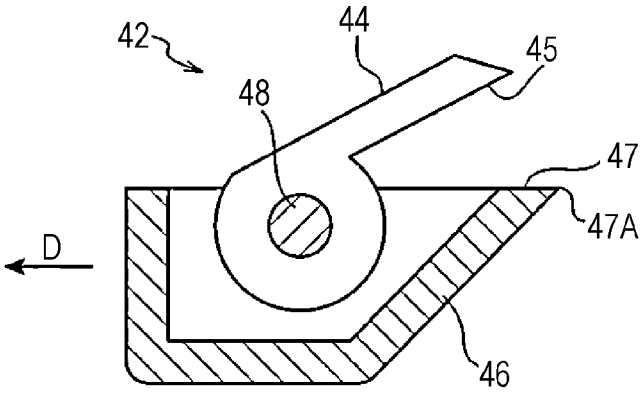
FIGS. 4A and 4B are sectional views illustrating action of the gripper of the image forming apparatus of FIG. 1.
Figure 4A:
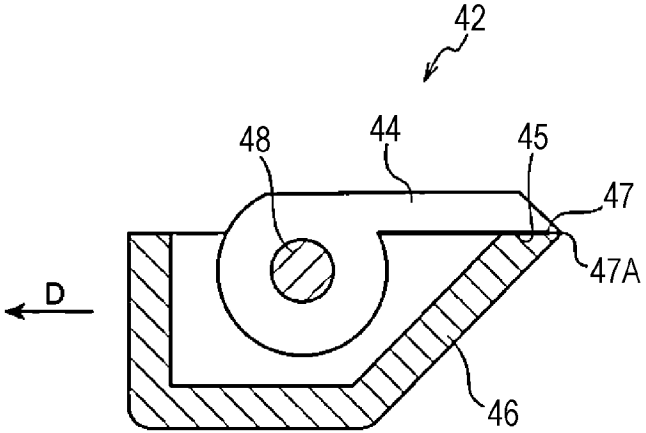

The case 46 extends in the depth direction, and is held by the shaft 48. The case 46 rotates independently from rotation of the clips 44. Moreover, the case 46 covers the clips 44 from the upstream side in the sheet transport direction, the downstream side in the sheet transport direction, and the back surface side of the sheet. The term "back surface" refers to a non-image-forming surface of the sheet P. With such a structure, tip portions 45 of the clips 44 and a fixed tab portion 47 at a back end of the case 46 can clamp a leading end portion P1 of the sheet P in the transport direction. The reference numeral 47A in FIGS. 4A and 4B represents a tip portion of the fixed tab portion 47.

Chain

As illustrated in FIG. 3, both end portions of the shaft 48 in the depth direction are held by the chains 49 for transport, each of which is an example of a circulating member. As the chains 49 circulate, the shaft 48 fixed to the chains 49 also circulates. Thus, the gripper 42 is held by the chains 49, which are disposed in a front part and a back part of the image forming apparatus 10, and circulates along a predetermined circulation path D (see FIG. 1).

As illustrated in FIG. 7, the chains 49 are wrapped around the transfer member 36, sprockets 37 that are disposed with a space therebetween in the depth direction, and the like, and are circulated by these members along the circulation path D.

Circulation Path D

As illustrated in FIG. 1, a part of the circulation path D overlaps the sheet transport path A in a front view of the image forming apparatus 10. To be specific, the circulation path D overlaps the sheet transport path A from a contact point with the sheet transport path A on the outer periphery of the sprocket 37, which is disposed below the transfer member 36, to the receiving position D2 (described below).

At the start point of overlapping of the circulation path D with the sheet transport path A, the tip portions 45 of the clips 44 and the fixed tab portion 47 of the case 46 are close to each other, and the gripper 42 grips the leading end portion P1 of the sheet P. A position in the circulation path D where the gripper 42 starts to hold the sheet P is a transfer position D1 where the sheet P is transferred from the sheet transport path A to the gripper 42.

At the end point of overlapping of the circulation path D with the sheet transport path A, the tip portions 45 of the clips 44 and the fixed tab portion 47 of the case 46 are separated from each other, and the leading end portion P1 of the sheet P is released. A position in the circulation path D where the gripper 42 releases the sheet P is the receiving position D2 where the sheet P is received by the sheet transport path A from the gripper 42. The transfer position D1 is located below the receiving position D2.

As illustrated in FIG. 1, in the present exemplary embodiment, when the sheet is transferred from the transport path A to the circulation path D, the sheet P is transferred from the left side to the right side with respect to the image forming position. In other words, the sheet feed direction at the transfer position D1 is a direction from the left side toward the right side.

On the other hand, when the sheet P is received by the circulation path D, the sheet P is received from the right side to the left side in FIG. 1. In other words, the sheet discharge direction at the receiving position D2 is from the right side to the left side.

A transport drum 31 is disposed at the receiving position D2 in the circulation path D. Sprockets (described below), around which the chains 49 are wrapped, are provided at both end portions of the transport drum 31 in the axial direction.

Position Adjuster

As illustrated in FIG. 1, a position adjuster 50 is disposed in the joining path in the sheet transport path A between the direction-changing path B and the transfer position D1.

Figure 5:
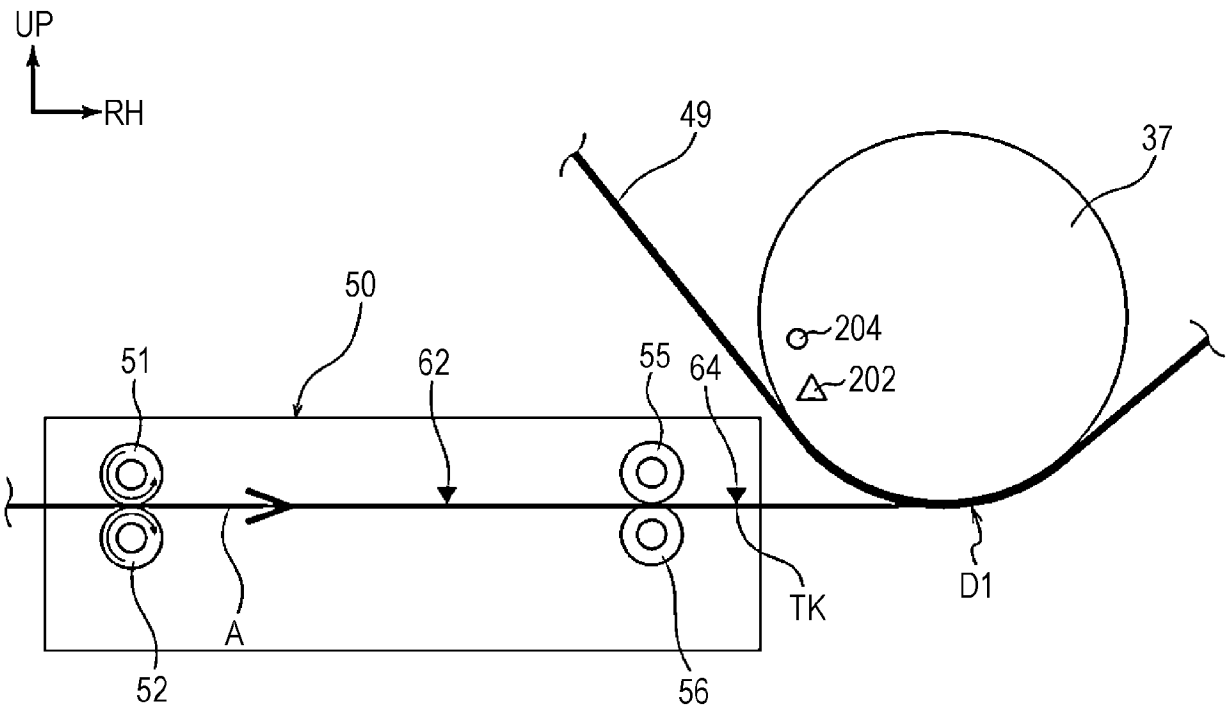
FIG. 5 is an enlarged view illustrating a position adjuster of the image forming apparatus of FIG. 1.

As illustrated in FIG. 5, the position adjuster 50 includes transport rollers 51 and 52, registration rollers 55 and 56, pass sensors 62 and 64, and the like. Each roller is disposed above or below the sheet transport path A. The transport roller 51 on the upper side and the transport roller 52 on the lower side make a pair and rotate, the registration roller 55 on the lower side and the registration roller 56 on the lower side make a pair and rotate, and these pairs transport the sheet P.

Each of the pass sensors 62 and 64 detects whether or not the sheet P, which is being transported along the sheet transport path A, has passed. By using signals received from the pass sensors 62 and 64, the controller 16 appropriately controls rotation of each of the transport rollers 51 and 52 and the registration rollers 55 and 56.

Actions in Position Adjuster

As illustrated in FIG. 5, when the leading end portion P1 (see FIG. 3) of the sheet P reaches the registration rollers 55 and 56, transportation of the sheet P temporarily stops, and the sheet P is fed out to the transfer position D1 as the registration rollers 55 and 56 are rotated at a set timing. The timing at which the registration rollers 55 and 56 are rotated is controlled as the pass sensor 62 detects the timing of passage of the leading end portion P1 of the sheet P.

Transfer of Sheet

Figure 6A:
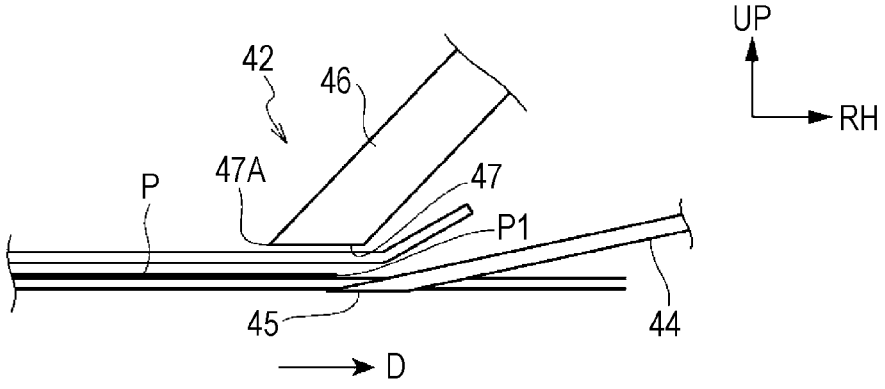
FIGS. 6A to 6C are enlarged views illustrating action of the gripper of the image forming apparatus of FIG. 1 in holding a leading end portion of a sheet.
Figure 6B:
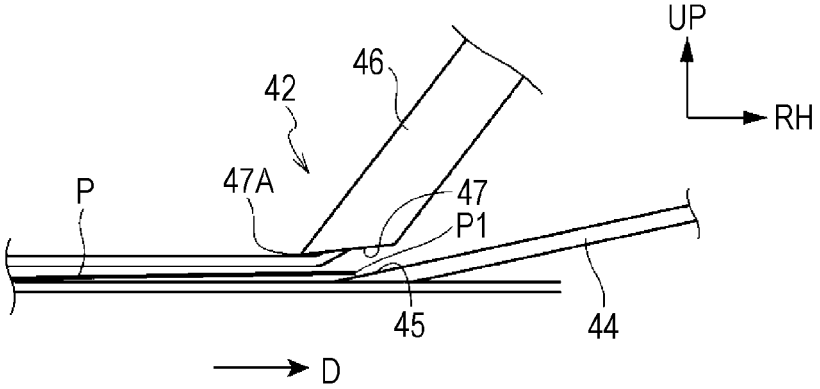
Figure 6C:
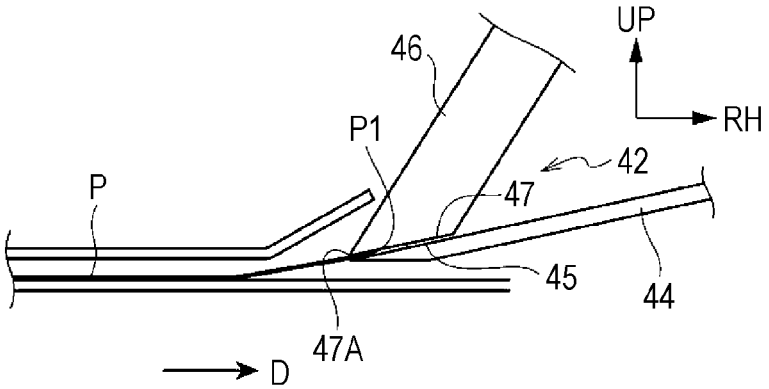

As illustrated in FIGS. 6A to 6C, the sheet P that has passed through the position adjuster 50 is held by the fixed tab portion 47 of the case 46 and the tip portions 45 of the clips 44 of the gripper 42 on the circumference of the sprocket 37 in FIG. 5. The gripper 42 is supplied while moving along the circulation path D in synchronism with the transport timing of the leading end portion P1 of the sheet P.

At this time, as illustrated in FIG. 6A, the case 46 and the clips 44 are in an opened state.

As illustrated in FIG. 6B, while the gripper 42 moves along the circulation path D in synchronism with the transport timing of the sheet P, the case 46 and the clips 44 gradually become closer to each other. Then, the tip portions 45 of the clips 44 raise the leading end portion P1 of the sheet P from the sheet transport path A.

As illustrated in FIG. 6C, the leading end portion P1 of the sheet P is further raised by the clips 44 and is transferred from the sheet transport path A to the circulation path D in a state in which the leading end portion P1 is held between the fixed tab portion 47 of the case 46 and the tip portions 45 of the clips 44. Subsequently, the sheet P is transported by the gripper 42 along the circulation path D.

A position where the sheet P is transferred from the sheet transport path A to the circulation path D is the transfer position D1.

Reversal of Sheet

As illustrated in FIG. 1, after the sheet P has been transferred to the circulation path D, the sheet P is reversed along the outer periphery of the transfer member 36. Then, the sheet P is transported to the image forming position 18 provided on the outer periphery of the transfer member 36. That is, the second transfer position 20 is configured so that the sheet P passes through the second transfer position 20 in the process in which the sheet P is reversed along the circulation path and the outer periphery of the transfer member 36.

A surface that faces a backup roller 33 when the sheet P passes through the image forming position 18 is an image forming surface and is the front surface. In other words, in the position adjuster 50 and at the transfer position D1, the sheet P is transported in a state in which the back surface of the sheet P, which is a non-image-forming surface, faces upward.

Reception of Sheet

The sheet P is received by the sheet transport path A from the circulation path D. The branching point between the circulation path D and the sheet transport path A is the receiving position D2. At the receiving position D2, the sheet P is received by the sheet transport path A from the circulation path D as the gripper 42, which is holding the leading end portion P1 (see FIG. 3) of the sheet P, is opened.

Partial Configurations

Next, partial configurations of the present exemplary embodiment will be described.

Figure 11:
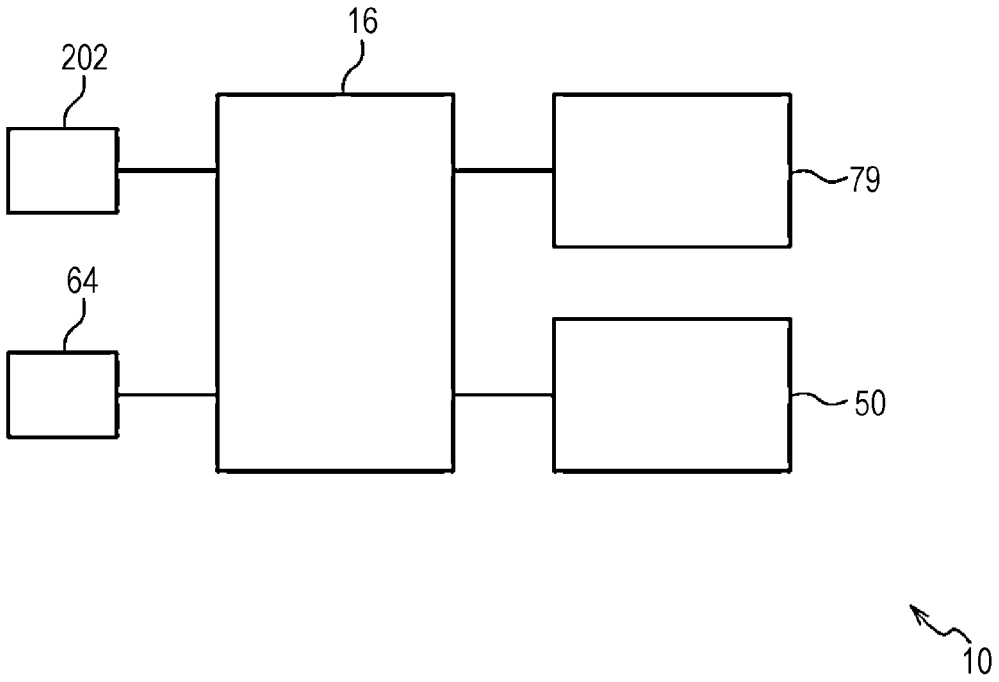
FIG. 11 is a block diagram of a part of the image forming apparatus of FIG. 1.

The controller 16 illustrated in FIG. 11 has a function of controlling the entirety of the image forming apparatus 10. The hardware configuration of the controller 16 is a computer including: a central processing unit (CPU) (not shown), a read only memory (ROM) storing programs and the like for realizing each process routine, a random access memory (RAM) for temporarily storing data, a memory as a storage unit a network interface, and the like.

A chain driving mechanism 79 illustrated in FIG. 11 circulates the transfer member 36 and the sprockets 37 (see FIG. 5 and other figures), around which the chains 49 are wrapped, and the like. The circulation velocity and the like of the chain driving mechanism 79 are controlled by the controller 16.

As illustrated in FIG. 5, the pass sensor 64 for detecting the leading end portion P1 (see FIG. 3) of the sheet P is disposed at a pass position TS (see FIG. 9) between the registration rollers 55 and 56 and the transfer position D1 in the sheet transport path A. A pass signal KS is defined as a signal indicating that the pass sensor 64 has detected the leading end portion P1 (see FIG. 3) of the sheet P at the pass position TS.

The image forming apparatus 10 includes a period sensor 202 for detecting the period of rotation of the sprocket 37. The period sensor 202 detects a detection portion 204 of the sprocket 37 every time the sprocket 37 rotates once. A period signal SS is defined as a signal detected by the period sensor 202 when the period sensor 202 detects the detection portion 204 every time the sprocket 37 rotates once.

As illustrated in FIG. 11, the pass signal KS detected by the pass sensor 64 and the period signal SS detected by the period sensor 202 are sent to the controller 16 (see also FIG. 1).

Figure 10:
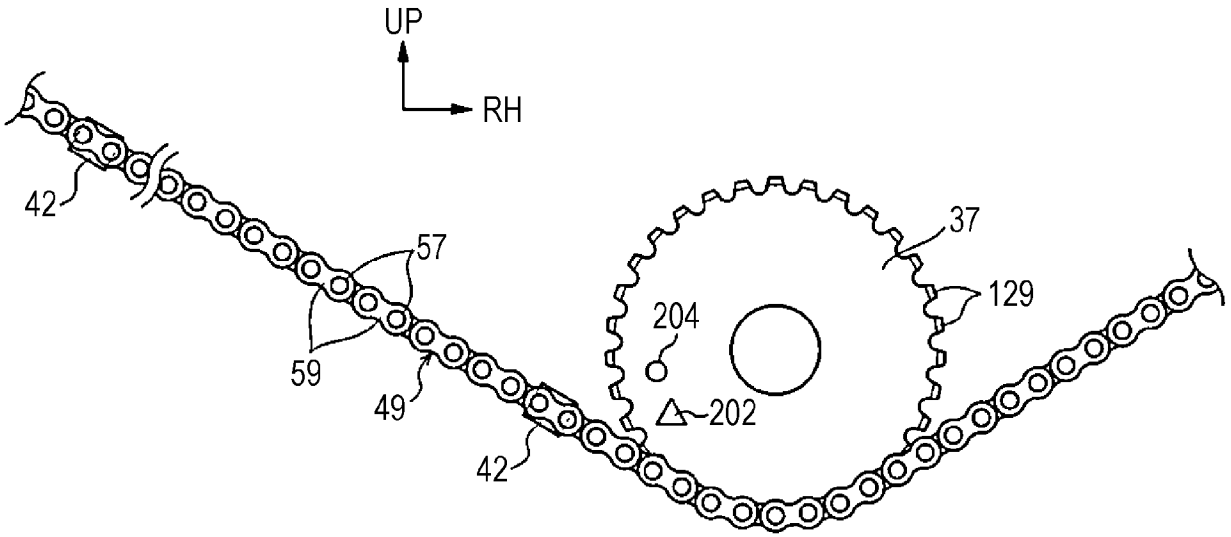
FIG. 10 is a front view of a part of the image forming apparatus of FIG. 1.

As illustrated in FIG. 10, the chain 49 has a structure such that roller links 59, which are formed by assembling link plates and bushes onto which freely rotatable rollers are fitted, are connected to each other via pin links 57.

Plural grippers 42 are fixed to the chain 49 at predetermined intervals. The number L1 of links between the grippers 42 that are adjacent to each other and fixed to the chain 49 coincides with the number L2 of teeth, which is the total number of teeth 129 of the sprocket 37. Thus, an entry period GS, which is a period at which the grippers 42 enter the transfer position D1, coincides with a rotation period PS, which is a period at which the sprocket 37 rotates once. Note that the number L1 of links between the grippers 42 that are adjacent to each other includes the number of roller links 59 to which the grippers 42 are fixed.

The position adjuster 50 illustrated in FIG. 5 can adjust the transport velocity of the sheet P, which has been fed out, by adjusting the rotation velocity of the registration rollers 55 and 56 and the like. The transport velocity of the sheet P, which is controlled by the position adjuster 50, is controlled by the controller 16 (see FIG. 11). The transport velocity of the sheet P is controlled so that the leading end portion P1 (see FIG. 3) of the sheet P enters the transfer position D1 after the transport velocity has decreased from that when the position adjuster 50 feeds out the sheet P.

To be specific, the controller 16 (see FIG. 11) performs control so that the following relationships hold:

$$V1>Vg,$$

$$V1>V2, \text{ and}$$

$$V2\approx Vg,$$

where Vg (m/s) is the circulation velocity of the gripper 42,

V1 (m/s) is a first transport velocity that is the transport velocity of the sheet P when the position adjuster 50 feeds out the sheet P, and V2 (m/s) is a second transport velocity that is the transport velocity of the sheet P when the leading end portion P1 (see FIG. 3) of the sheet P is at the transfer position D1.

V1 is in the range of greater than or equal to 1.02 times Vg to less than or equal to 1.09 times Vg. In the present exemplary embodiment, V1=Vg×1.05. V2 is in the range of Vg±1%, and, in the present exemplary embodiment, V2=Vg×1.005. These ranges are examples, and are not limited to these. These ranges may be appropriately set in accordance with specifications such as the circulation velocity. It is sufficient that at least "V1>Vg" and "V1>V2" are satisfied.

The circulation velocity Vg (m/s) of the gripper 42 is the same as the rotation velocity of the sprockets 37.

Moreover, in the present exemplary embodiment, the controller 16 (see FIG. 11) controls a timing TA (see FIG. 9), at which the sheet P starts to decelerate to the second transport velocity V2, so that the leading end portion P1 of the sheet P (see FIGS. 6A to 6C and FIGS. 8A to 8F) enters the transfer position D1 when the gripper 42 moves to the transfer position D1. A timing TB (see FIG. 9) is defined as a timing at which the sheet P finishes decelerating to the second transport velocity V2.

Figure 8A:
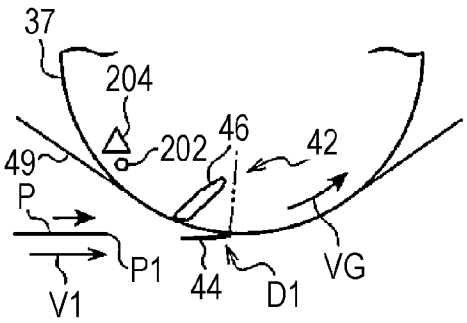
FIGS. 8A to 8F are front views illustrating transportation of a sheet and action of the gripper in the image forming apparatus of FIG. 1.
Figure 8B:
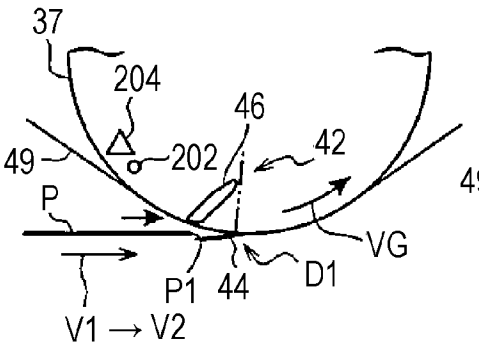
Figure 8C:
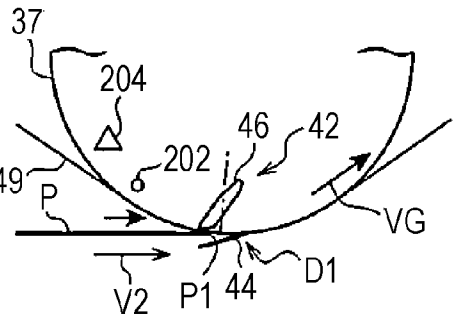
Figure 8D:
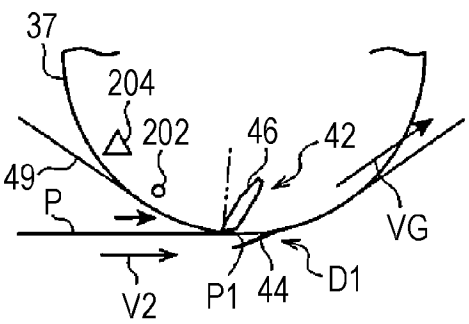
Figure 8E:
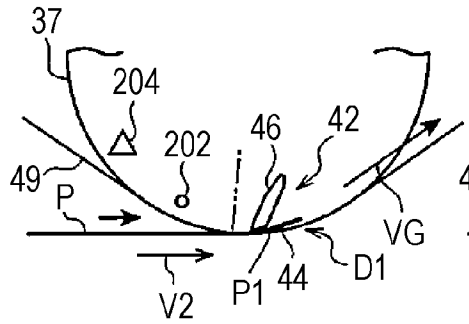
Figure 8F:
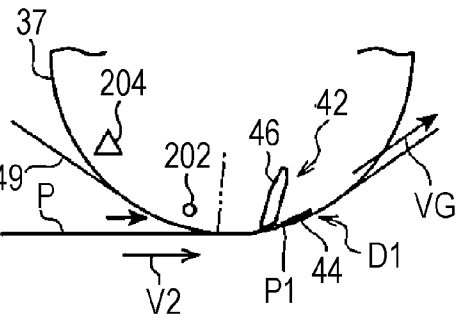
Figure 9:
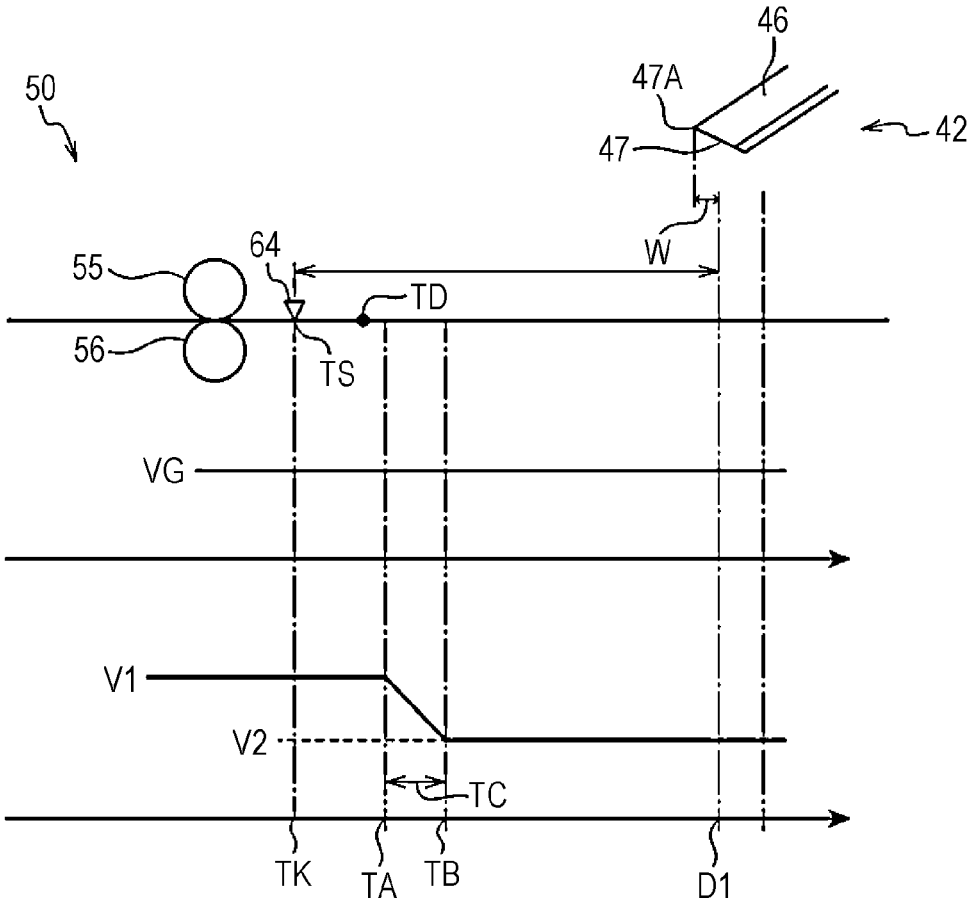
FIG. 9 is a view illustrating adjustment of the transport velocity of a sheet in the image forming apparatus of FIG. 1.

A time interval TC between the timing TA and the timing TB illustrated in FIG. 9 is controlled to be constant. The timing TB, at which the sheet P finishes decelerating to the second transport velocity V2, is set so that the timing TB is earlier than the time when the leading end portion P1 of the sheet P (see FIGS. 6A to 6C and FIGS. 8A to 8F) enters the transfer position D1.

To be specific, as illustrated in FIG. 8A, the position adjuster 50 feeds out the sheet P at the first transport velocity V1. As illustrated in FIG. 8B, the controller 16 controls the position adjuster 50 to start to decelerate the sheet P to the second transport velocity V2. As illustrated in FIG. 8C, in a state in which the sheet P has decelerated to the second transport velocity V2, the leading end portion P1 of the sheet P enters the transfer position D1. The transfer position D1 in the present exemplary embodiment is a position that is forward from the tip portion 47A of the fixed tab portion 47 by W (mm) in the transport direction. In the present exemplary embodiment, W is 5 mm.

From a different viewpoint, the position adjuster 50 feeds out the sheet P at a transport velocity higher than the circulation velocity of the gripper 42, and the transport velocity of the sheet P is reduced after the leading end portion P1 of the sheet P has entered into the gripper 42. The phrase "enter into the gripper 42" represents that the sheet P enters a space between the case 46 and the clips 44 of the gripper 42. To be more specific, this is a state in which an imaginary line connecting the tip of the case 46 and the tips of the clips 44 intersects the sheet P.

Then, as illustrated in FIGS. 8D to 8F, the gripper 42 holds the leading end portion P1 of the sheet P and transports the sheet P.

In the present exemplary embodiment, the controller 16 (see FIG. 11) adjusts the timing TA (see FIG. 8B), at which the sheet P starts to decelerate to the second transport velocity V2, by using the time difference t between the period signal SS of the sprocket 37, which is detected by the period sensor 202 (see FIG. 5), and the pass signal KS, which indicates that the pass sensor 64 has detected the leading end portion P1 (see FIG. 3) of the sheet P at the pass position TS (see FIG. 5).

To be specific, the controller 16 (see FIG. 1) performs control as follows.

A reference value t0 is defined as a reference value of a designed time difference t, and a reference timing TD is defined as a reference value of a timing at which the sheet P is designed to start to decelerate. An actually measured value t1 is defined as the time difference between the period signal SS and the pass signal KS that are actually detected by the pass sensor 64 and the period sensor 202, and Δt is defined as the time difference between the actually measured value t1 and the reference value t0. The controller 16 (see FIG. 11) sets the timing TA based on the reference timing TD and Δt.

From a different viewpoint, if the actually measured value t1 of the time difference between the pass signal KS and the period signal SS is large, the timing TA, at which the sheet P starts to decelerate to the second transport velocity V2, is advanced compared with a case where t1 is small.

Operational Effects

Next, operational effects of the present exemplary embodiment will be described.

The controller 16 performs control so that the following relationships hold:

$$V1>Vg, \text{ and}$$

$$V1>V2,$$

where Vg (m/s) is the circulation velocity of the gripper 42,

V1 (m/s) is the first transport velocity that is the transport velocity of the sheet P when the position adjuster 50 feeds out the sheet P, and V2 (m/s) is the second transport velocity that is the transport velocity of the sheet P when the leading end portion P1 of the sheet P is at the transfer position D1.

From a different viewpoint, the controller 16 performs control so that the position adjuster 50 feeds out the sheet P at a transport velocity higher than the circulation velocity of the gripper 42 and so that the transport velocity of the sheet P is reduced after the leading end portion P1 of the sheet P has entered into the gripper 42.

Thus, it is possible to suppress failure of the gripper 42 in holding the leading end portion P1 of the sheet P, compared with a case where the leading end portion P1 of the sheet P fed out by the position adjuster 50 enters the transfer position D1 without changing a constant transport velocity.

Here, the above fact will be described in detail.

As a first comparative example, a case where the leading end portion P1 of the sheet P enters the transfer position D1 without changing the first transport velocity V1, at which the position adjuster 50 has fed out the sheet P, is assumed. In this case, because the transport velocity of the sheet P at the transfer position D1 is higher the circulation velocity Vg of the gripper 42, failure of the gripper 42 in holding the leading end portion P1 of the sheet P tends to occur.

As a second comparative example, a case where the position adjuster 50 feeds out the sheet P at the second transport velocity V2 and the leading end portion P1 enters the transfer position D1 without changing the transport velocity is assumed. In this case, the transport velocity of the sheet P when the position adjuster 50 feeds out the sheet P is the substantially same as the circulation velocity of the gripper 42. Thus, the leading end portion P1 of the sheet P cannot catch up the gripper 42 and it is not possible or is difficult for the gripper 42 to hold the leading end portion P1, and holding failure tends to occur.

In contrast, with the present exemplary embodiment, the gripper 42 can easily hold the leading end portion P1 of the sheet P and occurrence of holding failure is suppressed, by making the first transport velocity V1, at which the position adjuster 50 feeds out the sheet P, be higher than the circulation velocity Vg of the gripper 42 and by making the second transport velocity V2, which is the transport velocity of the sheet P when the leading end portion P1 of the sheet P is at the transfer position D1 after decelerating thereafter, be the same as or substantially the same as the circulation velocity Vg.

In the present exemplary embodiment, the timing at which the sheet P starts to decelerate to the second transport velocity V2 is adjusted so that the leading end portion P1 of the sheet P enters the transfer position D1 when the gripper 42 moves to the transfer position D1.

Thus, the controller 16 can easily perform control, compared with a case where the leading end portion P1 of the sheet P is made to enter the transfer position D1 when the gripper 42 moves to the transfer position D1 by adjusting the length of time during which the transport velocity of the sheet P decreases from the first transport velocity V1 to the second transport velocity V2, that is, the length of the time interval TC between the timing TA and the timing TB.

In the present exemplary embodiment, the rotation period PS, which is a period at which the sprocket 37 rotates once, coincides with the entry period GS, which is a period at which the grippers 42 enter the transfer position D1. Thus, it is possible to estimate the timing at which each gripper 42 enters the transfer position D1 with high accuracy by using the period signal SS of the sprocket 37 detected by the period sensor 202.

The timing TA, at which the sheet P starts to decelerate to the second transport velocity V2, is adjusted by using the period signal SS of the sprocket 37 detected by the period sensor 202 and the pass signal KS, which indicates that the pass sensor 64 has detected the leading end portion P1 of the sheet P at the pass position TS. Thus, it is possible to adjust the timing TA, at which the sheet P starts to decelerate to the second transport velocity V2, with high accuracy compared with, for example, a case where only the pass signal KS is used.

With the present exemplary embodiment, by making the number L1 of links between the grippers 42 that are adjacent to each other and that are fixed to the chain 49 be the same as the number L2 of teeth, which is the total number of the teeth 129 of the sprocket 37, it is possible to make the rotation period PS, at which the sprocket 37 rotates once, coincide with the entry period GS, at which the grippers 42 enter the transfer position D1.

In the present exemplary embodiment, the period during which the transport velocity of the sheet P decreases from the first transport velocity V1 to the second transport velocity V2, that is, the time interval TC between the timing TA and the timing TB is constant. Thus, the timing at which the leading end portion P1 of the sheet P enters the transfer position D1 is stable, compared with a case where the time interval TC is not constant.

In the present exemplary embodiment, the sheet P has finished decelerating to the second transport velocity V2 before the leading end portion P1 of the sheet P enters the transfer position D1. Thus, the gripper 42 can stably hold the leading end portion P1 of the sheet P, compared with a case where the sheet P finishes decelerating to the second transport velocity V2 after the leading end portion P1 of the sheet P has entered the transfer position D1.

Second Exemplary Embodiment

An image forming apparatus according to a second exemplary embodiment of the present disclosure will be described. Partial configurations will only be described, because the image forming apparatus according to the second exemplary embodiment differs from the first exemplary embodiment only in partial configurations. Redundant description will be omitted or simplified, and the same members and the like will be denoted by the same reference numerals.

Partial Configurations

Next, the partial configurations of the present exemplary embodiment will be described.

The controller 16 (see FIG. 11) performs control so that the following relationships hold:

$$V1>Vc>Vg,$$

$$V1>Vc>V2, \text{ and}$$

$$V2\approx Vg$$

where Vg (m/s) is the circulation velocity of the gripper 42,

V1 (m/s) is the first transport velocity that is the transport velocity of the sheet P when the position adjuster 50 feeds out the sheet P, V2 (m/s) is the second transport velocity that is the transport velocity of the sheet P when the leading end portion P1 (see FIG. 3) of the sheet P is at the transfer position D1, and Vc (m/s) is an intermediate transport velocity between the first transport velocity V1 (m/s) and the second transport velocity V2 (m/s).

V1 is in the range of greater than or equal to 1.02 times Vg to less than or equal to 1.09 times Vg. In the present exemplary embodiment, V1=Vg×1.05. V2 is in the range of Vg±1%, and, in the present exemplary embodiment, V2=Vg×1.005. In the present exemplary embodiment, Vc=(V1+V2)/2. These ranges are examples, and are not limited to these. These ranges may be appropriately set in accordance with specifications such as the circulation velocity. It is sufficient that at least "V1>Vc>Vg" and "V1>Vc>V2" are satisfied.

The circulation velocity Vg (m/s) of the gripper 42 is the same as the rotation velocity of the sprockets 37.

Figure 14:
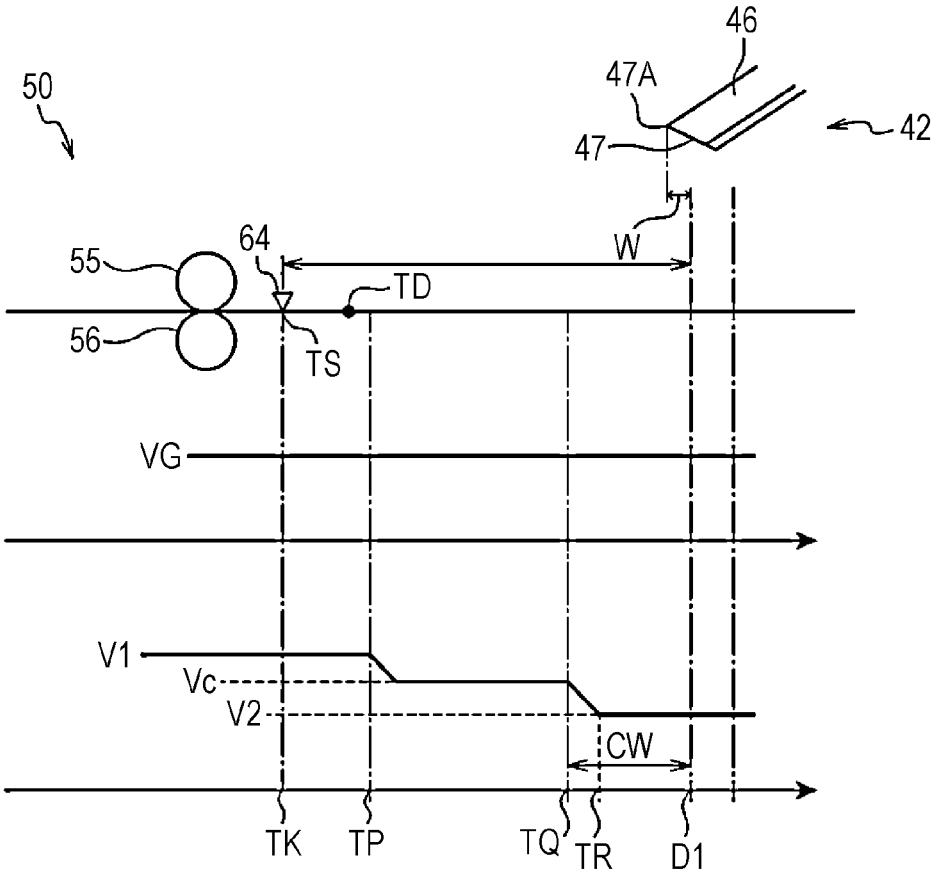
FIG. 14 is a view, corresponding to FIG. 9, illustrating adjustment of the transport velocity of a sheet in the image forming apparatus according to the second exemplary embodiment.

As illustrated in FIG. 14, the controller 16 (see FIG. 11) performs control so that, after reducing the transport velocity of the sheet P when the position adjuster 50 feeds out the sheet P from the first transport velocity V1 to the intermediate transport velocity Vc and transporting the sheet P, the position adjuster 50 decelerates the sheet P to the second transport velocity V2 and the leading end portion P1 (see FIG. 3) of the sheet P enters the transfer position D1.

The sheet P starts to decelerate from the intermediate transport velocity Vc to the second transport velocity V2 at a predetermined timing TQ. The timing TQ is before the transfer position D1 by CW, and CW is 10 mm in the present exemplary embodiment.

In the present exemplary embodiment, the controller 16 (see FIG. 11) controls a timing TP, at which the sheet P starts to decelerate to the intermediate transport velocity Vc, so that the leading end portion P1 of the sheet P (see FIGS. 6A to 6C and FIGS. 8A to 8F) enters the transfer position D1.

The timing TR, at which the sheet P finishes decelerating from the intermediate transport velocity Vc to the second transport velocity V2, is set so that the timing TR is earlier than the time when the leading end portion P1 of the sheet P (see FIGS. 6A to 6C and FIGS. 8A to 8F) enters the transfer position D1.

Figure 13A:
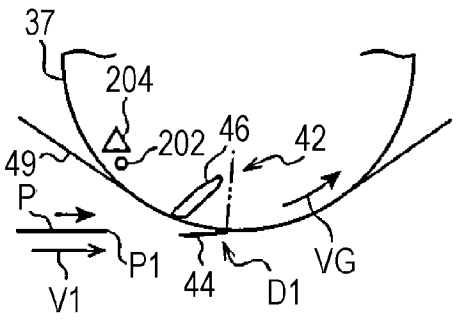
FIGS. 13A to 13F are front views, respectively corresponding to FIGS. 8A to 8F, illustrating transportation of a sheet and action of the gripper in an image forming apparatus according to a second exemplary embodiment.
Figure 13B:
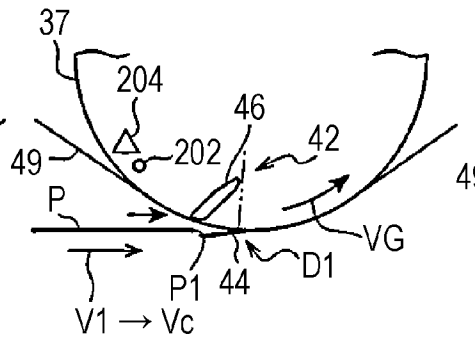
Figure 13C:
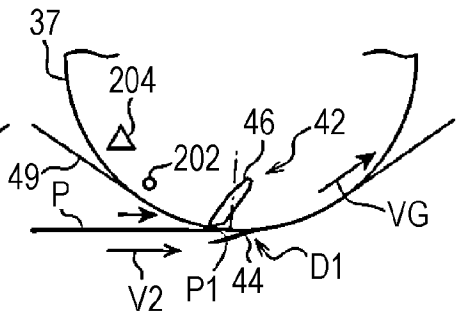
Figure 13D:
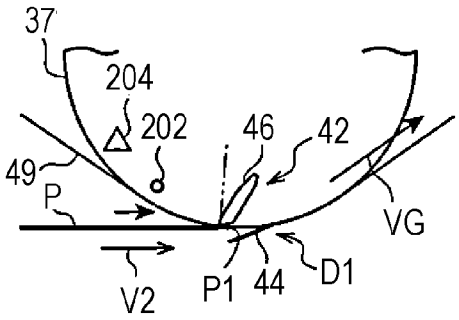
Figure 13E:
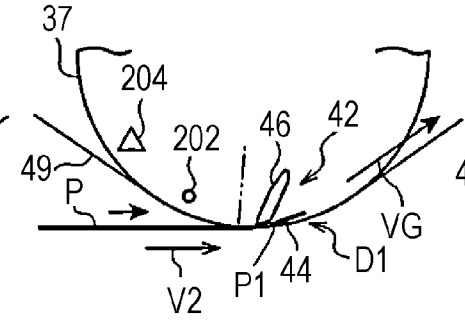
Figure 13F:
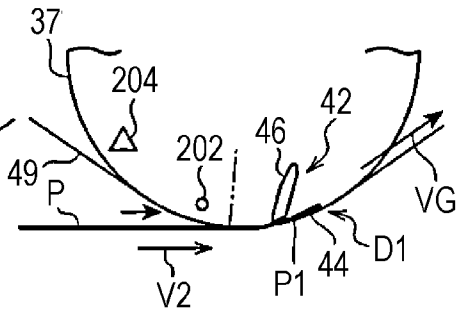

To be specific, as illustrated in FIG. 13A, the position adjuster 50 feeds out the sheet P at the first transport velocity V1. As illustrated in FIG. 13B, the controller 16 controls the position adjuster 50 to reduce the transport velocity of the sheet P to the intermediate transport velocity Vc and to transport the sheet P at the intermediate transport velocity Vc. As illustrated in FIG. 13C, the controller 16 controls the position adjuster 50 to decelerate the sheet P from the intermediate transport velocity Vc to the second transport velocity V2 at the predetermined timing TR (see FIG. 14) and to make the leading end portion P1 of the sheet P enter the transfer position D1 in a state in which the sheet P has finished decelerating to the second transport velocity V2. The transfer position D1 in the present exemplary embodiment is a position that is forward from the tip portion 47A of the fixed tab portion 47 by W (mm) in the transport direction. In the present exemplary embodiment, W is 5 mm. Then, as illustrated in FIGS. 13D to 13F, the gripper 42 holds the leading end portion P1 of the sheet P and transports the sheet P.

In the present exemplary embodiment, the controller 16 (see FIG. 11) adjusts the timing TP (see FIG. 14), at which the sheet P starts to decelerate to the intermediate transport velocity Vc, by using the time difference t between the period signal SS of the sprocket 37, which is detected by the period sensor 202 (see FIG. 5), and the pass signal KS, which indicates that the pass sensor 64 has detected the leading end portion P1 (see FIG. 3) of the sheet P at the pass position TS (see FIG. 5).

To be specific, the controller 16 (see FIG. 1) performs control as follows.

A reference value t0 is defined as a reference value of a designed time difference t, and a reference timing TD is defined as a reference value of a timing at which the sheet P is designed to start to decelerate. An actually measured value t1 is defined as the time difference between the period signal SS and the pass signal KS that are actually detected by the pass sensor 64 and the period sensor 202, and Δt is defined as the time difference between the actually measured value t1 and the reference value t0. The controller 16 (see FIG. 11) sets the timing TP (see FIG. 14) based on the reference timing TD and Δt.

From a different viewpoint, if the actually measured value t2 of the time difference between the pass signal KS and the period signal SS is large, the timing TP, at which the sheet P starts to decelerate to the intermediate transport velocity Vc, is advanced compared with a case where t1 is small.

Operational Effects

Next, operational effects of the present exemplary embodiment will be described.

The controller 16 performs control so that the following relationships hold:

$$V1>Vc>Vg, \text{ and}$$

$$V1>Vc>V2$$

where Vg (m/s) is the circulation velocity of the gripper 42,

V1 (m/s) is the first transport velocity that is the transport velocity of the sheet P when the position adjuster 50 feeds out the sheet P, V2 (m/s) is the second transport velocity that is the transport velocity of the sheet P when the leading end portion P1 (see FIG. 3) of the sheet P is at the transfer position D1, and Vc (m/s) is the intermediate transport velocity between the first transport velocity V1 (m/s) and the second transport velocity V2 (m/s).

The controller 16 performs control so that, after reducing the transport velocity of the sheet P when the position adjuster 50 feeds out the sheet P from the first transport velocity V1 to the intermediate transport velocity Vc and transporting the sheet P, the position adjuster 50 decelerates the sheet P to the second transport velocity V2 and the leading end portion P1 of the sheet P enters the transfer position D1.

Thus, it is possible to suppress failure of the gripper 42 in holding the leading end portion P1 of the sheet P, compared with a case where the leading end portion P1 of the sheet P fed out by the position adjuster 50 enters the transfer position D1 without changing a constant transport velocity.

Moreover, the accuracy with which the leading end portion P1 of the sheet P enters the transfer position D1 in a state in which the transport velocity is reduced to the second transport velocity V2 is improved, compared with a case where the transport velocity is reduced directly from the first transport velocity V1 to the second transport velocity V2. Therefore, it is possible to further suppress failure of the gripper 42 in holding the leading end portion P1 of the sheet P.

In the present exemplary embodiment, the timing at which the sheet P starts to decelerate to the intermediate transport velocity Vc is adjusted so that the leading end portion P1 of the sheet P enters the transfer position D1 when the gripper 42 moves to the transfer position D1. Thus, the controller 16 can easily perform control compared with a case where the leading end portion P1 of the sheet P is made to enter the transfer position D1 when the gripper 42 moves to the transfer position D1 by adjusting the length of time during which the transport velocity of the sheet P decreases from the first transport velocity V1 to the intermediate transport velocity Vc.

In the present exemplary embodiment, the rotation period PS, which is a period at which the sprocket 37 rotates once, coincides with the entry period GS, which is a period at which the grippers 42 enter the transfer position D1. Thus, it is possible to estimate the timing at which each gripper 42 enters the transfer position D1 with high accuracy by using the period signal SS of the sprocket 37 detected by the period sensor 202.

The timing TQ, at which the sheet P starts to decelerate to the intermediate transport velocity Vc, is adjusted by using the period signal SS of the sprocket 37 detected by the period sensor 202 and the pass signal KS, which indicates that the pass sensor 64 has detected the leading end portion P1 of the sheet P at the pass position TS. Thus, it is possible to adjust the timing TQ, at which the sheet P starts to decelerate to the intermediate transport velocity Vc, with high accuracy compared with, for example, a case where only the pass signal KS is used.

With the present exemplary embodiment, by making the number L1 of links between the grippers 42 that are adjacent to each other and that are fixed to the chain 49 be the same as the number L2 of teeth, which is the total number of the teeth 129 of the sprocket 37, it is possible to make the rotation period PS, at which the sprocket 37 rotates once, coincide with the entry period GS, at which the grippers 42 enter the transfer position D1.

In the present exemplary embodiment, the sheet P has finished decelerating to the second transport velocity V2 before the leading end portion P1 of the sheet P enters the transfer position D1. Thus, the gripper 42 can stably hold the leading end portion P1 of the sheet P, compared with a case where the sheet P finishes decelerating to the second transport velocity V2 after the leading end portion P1 of the sheet P has entered the transfer position D1.

Modification

Next, a modification of the second exemplary embodiment will be described.

In the exemplary embodiments described above, the timing TQ at which the sheet P starts to decelerate from the intermediate transport velocity Vc to the second transport velocity V2, which is illustrated in FIG. 14, is constant. However, the controller 16 (see FIG. 11) in the modification adjusts the timing TQ in accordance with the type of the sheet P.

To be specific, if the stiffness of the sheet P is low, the leading end portion P1 of the sheet P may become curved and the leading end portion P1 may enter the transfer position D1 with a time lag, and therefore it is necessary to delay the timing TQ to compensate for the time lag.

Thus, in the present modification, the timing TQ is adjusted in accordance with the type of the sheet P. That is, if the stiffness of the sheet P is low due to a small thickness or the like, the timing TQ is delayed compared with a case where the stiffness of the sheet P is high due to a large thickness or the like.

To be specific, the controller 16 stores timing TQ corresponding to each type of the sheet P, and starts to decelerate the sheet P to the intermediate transport velocity Vc at the stored timing TQ. The type of the sheet P may be detected by a sensor, or a user may input the type of the sheet P from an operation panel or the like.

In this way, the controller 16 (see FIG. 11) adjusts the timing TQ in accordance with the type of the sheet P. Therefore, it is possible to further suppress failure of the gripper 42 in holding the leading end portion P1 of the sheet P, compared with a case where the timing TQ is constant.

The term "stiffness" of the sheet P refers to resistance generated when a bending force is applied to the sheet P. From a different viewpoint, the stiffness of the sheet P is the rigidity of the sheet P.

Another Example of Image Forming Section

Next, another example of the image forming section of the image forming apparatus according to the first exemplary embodiment and the second exemplary embodiment will be described.

Figure 12:
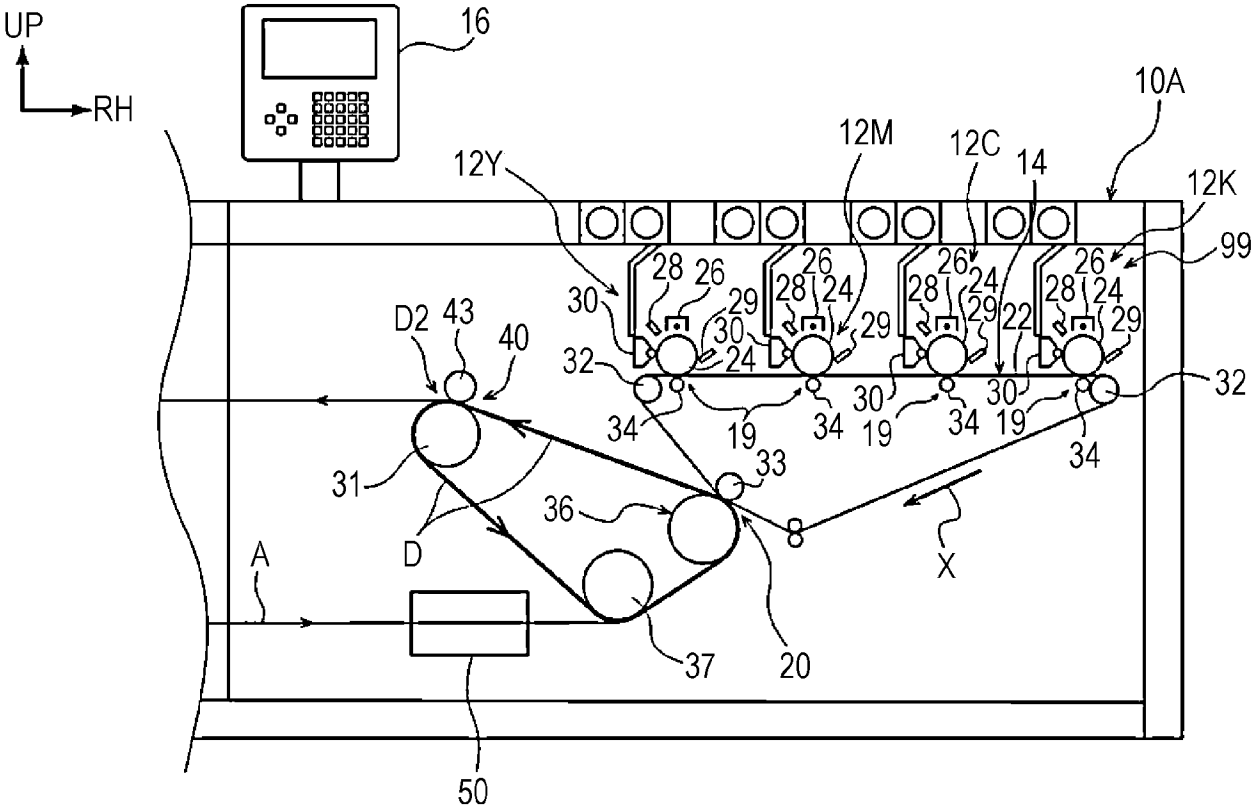
FIG. 12 is an enlarged view, corresponding to FIG. 2, of a region around an image forming position of another example of an image forming section of an image forming apparatus.

An image forming section 99 illustrated in FIG. 12 includes an image forming unit 12 (described below) for forming an image by using an electrophotographic method, an intermediate transfer belt 22 for holding the formed image, and an intermediate transfer unit 14 for mounting and supporting the intermediate transfer belt 22. In the image forming apparatus 10, a transfer member 36 for transferring an image from the intermediate transfer unit 14 to the sheet P for image recording is disposed on the left lower side of the intermediate transfer unit 14.

A second transfer position 20 is an example of an image forming position where the intermediate transfer belt 22 and the transfer member 36 are in contact with each other. At the second transfer position 20, a toner image that is formed by the image forming unit 12 is transferred to a surface of the sheet P via the intermediate transfer belt 22 mounted in the intermediate transfer unit 14.

The image forming section 99 includes plural image forming units 12 for respectively forming toner layers of different colors. In the present exemplary embodiment, the image forming section 99 includes four image forming units 12, which are a yellow image forming unit 12Y, a magenta image forming unit 12M, a cyan image forming unit 12C, and a black image forming unit 12K, corresponding to respective colors.

Yellow (Y), magenta (M), cyan (C), and black (K) are four colors for outputting a color image. In the following description, unless it is necessary to distinguish between the colors, each the image forming unit 12 will be simply referred to as "image forming unit 12", without using a character Y, M, C, or K.

The image forming units 12 for the respective colors basically have the same configuration, except for the types of toners used. Each image forming unit 12 includes a cylindrical photoconductor 24 that rotates and a charger 26 that charges the photoconductor 24. The image forming unit 12 includes an exposure device 28, which forms an electrostatic latent image by irradiating the charged photoconductor 24 with exposure light, and a developing device 30, which develops electrostatic latent image into an image formed of toner layers by using a developer. The image forming unit 12 further includes a cleaner 29 that removes toner that remains on the surface of the photoconductor 24 after toner has been transferred from the photoconductor 24 to the intermediate transfer belt 22.

The photoconductor 24 for each color is capable of being in contact with the outer peripheral surface of the intermediate transfer belt 22. The image forming units 12 corresponding to yellow, magenta, cyan, and black are arranged from the upstream side toward the downstream side in the circulation direction of the intermediate transfer belt 22.

Intermediate Transfer Unit

The intermediate transfer unit 14 includes first transfer rollers 34 facing the image forming units 12 for the respective colors and a backup roller 33 facing the transfer member 36.

Intermediate Transfer Belt

The intermediate transfer belt 22 is an endless belt. The intermediate transfer belt 22 is wrapped around plural rollers 32 to assume a position as follows. In the present exemplary embodiment, in a front view, the position of the intermediate transfer belt 22 has a substantially obtuse-triangular shape that is long in the apparatus width direction and that has an obtuse-angle vertex in the downward direction. One of the plural rollers 32 (not shown) has a function of receiving motive power of a motor and rotating the intermediate transfer belt 22 in the direction of arrow X. The intermediate transfer belt 22 transports a first-transferred image to the second transfer position 20 by rotating in the direction of arrow X.

The intermediate transfer belt 22 can circulate in the direction of arrow X in a state of being in contact with or separated from the photoconductors 24 for the respective colors.

First Transfer

Each first transfer region 19 is composed of a contact portion where the photoconductor 24, the intermediate transfer belt 22, and the first transfer roller 34 are in contact with each other. The first transfer roller 34 faces the photoconductor 24 with the intermediate transfer belt 22 therebetween. The first transfer roller 34 and the intermediate transfer belt 22 are in contact with each other with a predetermined load.

To the first transfer roller 34, a predetermined voltage is applied by a power supply (not shown). The voltage is a first transfer voltage for first transferring a toner image, which has been formed on the photoconductor 24, to the intermediate transfer belt 22 at a position between the photoconductor 24 and the first transfer roller 34.

Transfer Member

The transfer member 36 is disposed at a position facing the backup roller 33 with the intermediate transfer belt 22 therebetween. The transfer member 36 has a cylindrical shape whose axial direction is the depth direction of the image forming apparatus 10, and is rotatable in the circumferential direction.

To the transfer member 36, a voltage is applied by a power supply (not shown). The voltage is a second transfer voltage for second transferring toner images, which have been overlappingly transferred to the intermediate transfer belt 22, to the sheet P transported to the second transfer position 20.

Second Transfer

The second transfer position 20 is formed of a contact portion where the intermediate transfer belt 22 and the transfer member 36, having a roller-like shape, are in contact with each other. The intermediate transfer belt 22 and the transfer member 36 are in contact with each other with a predetermined load due to the backup roller 33 facing the transfer member 36.

Fixing Device

A fixing device 40 is disposed downstream of the second transfer position 20 in the transport direction of the sheet P. The fixing device 40 includes a transport drum 31 and a heating roller 43 that face each other. The transport drum 31 and the heating roller 43 face each other with the sheet transport path A (described above) therebetween. That is, the sheet P, to which an image is to be fixed, is transported so as to pass between the transport drum 31 and the heating roller 43.

Image Forming Operation of forming Basic Image

Next, an overview of a basic image forming operation performed by the image forming section 99 on the sheet P will be described.

When receiving an image forming command from the outside, the controller 16 activates each image forming unit 12. The photoconductor 24 for each color is charged by the charger 26 while rotating. The controller 16 sends image data, which has been image-processed by an image signal processor (not shown), to each exposure device 28. Each exposure device 28 irradiates a corresponding photoconductor 24 with light, and thereby exposes the charged photoconductor 24 with the light. Thus, an electrostatic latent image is formed on the outer peripheral surface of each photoconductor 24. The electrostatic latent image formed on each photoconductor 24 is developed by a corresponding developing device 30, and a toner image for each color is formed on the photoconductor 24.

Each color toner image formed on the photoconductor 24 for the color is first-transferred to the intermediate transfer belt 22 by the first transfer roller 34 for the color in each first transfer region. At this time, as the intermediate transfer belt 22 circulates, the color toner images are successively first-transferred to the intermediate transfer belt 22 while being superposed on each other. The toner images that have been superposed in this way are transported to the second transfer position 20 as the intermediate transfer belt 22 circulates. Then, the superposed toner images are transferred from the intermediate transfer belt 22 to the sheet P at the second transfer position 20.

The sheet P, onto which the toner images have been second-transferred, is transported toward the fixing device 40. In the fixing device 40, the fixing roller heats and presses the sheet P. Thus, the toner images, which have been formed by the image forming units 12, are fixed to the sheet P.

In duplex printing, the transport direction of the sheet P that has passed through the fixing device 40 is changed in the direction-changing path B of the transport path. Then, the sheet P is transported along the transport path C, which includes plural rollers (not shown), again to the sheet transport path A.

Others

The present disclosure is not limited to the exemplary embodiments described above.

For example, in the exemplary embodiments described above, the transport velocity when the position adjuster 50 feeds out the sheet P is the first transport velocity V1 (m/s). However, the transport velocity is not limited to this. The position adjuster 50 may feed out the sheet P at a third transport velocity V3 that is higher or lower than the first transport velocity V1 (m/s), and subsequently, may change the transport velocity from the third transport velocity V3 to the first transport velocity V1 (m/s).

If the third transport velocity V3 is lower than the first transport velocity V1 (m/s), the magnitude relationship between the third transport velocity V3 and the circulation velocity Vg of the gripper 42 (m/s) is not specified. That is, any of V3>Vg, V3=Vg, and V3<Vg may hold.

If the third transport velocity V3 is lower than the first transport velocity V1 (m/s), the magnitude relationship between the third transport velocity V3 and the second transport velocity V2 is not specified. That is, any of V3>V2, V3=V2, and V3<V2 may hold.

For example, in the exemplary embodiments described above, the timing TA, at which the sheet P starts to decelerate to the second transport velocity V2, or the timing TQ, at which the sheet P starts to decelerate to the intermediate transport velocity Vc, is adjusted by using the period signal SS of the sprocket 37, which is detected by the period sensor 202, and the pass signal KS, which indicates that pass sensor 64 has detected the leading end portion P1 of the sheet P at the pass position TS. However, a method of adjusting the timings is not limited to this. The timing TA at which the sheet P starts to decelerate to the second transport velocity V2 or the timing TQ at which the sheet P starts to decelerate to the intermediate transport velocity Vc may be adjusted by using another signal.

For example, in the exemplary embodiments described above, the timing at which the sheet P starts to decelerate to the second transport velocity V2 or the timing TQ at which the sheet P starts to decelerate to the intermediate transport velocity Vc is adjusted so that the leading end portion P1 of the sheet P enters the transfer position D1 when the gripper 42 moves to the transfer position D1. However, the timing is not limited to this. The timing TA at which the sheet P starts to decelerate to the second transport velocity V2 or the timing TQ at which the sheet starts to decelerate to the intermediate transport velocity Vc may be fixed.

For example, the image forming section 99 of the exemplary embodiment described above, which uses an electrophotographic method, transfers a toner image held by the intermediate transfer belt 22, which is an example of an image carrier and an intermediate transfer member, to the sheet P. However, the configuration of the image forming apparatus is not limited to this. The image forming apparatus may transfer a toner image held by a photoconductor, which is an example of an image carrier, to a recording medium.

For example, in the exemplary embodiments described above, the image forming method used in the image forming section is an inkjet method or an electrophotographic method. However, the image forming method is not limited to these. The image forming section may use another image forming method, such as an offset printing method.

For example, in the exemplary embodiments described above, the gripper 42, which is an example of a holding member, is used as a member for physically holding the leading end portion P1 of the sheet P. However, the structure of a holding member is not limited to such a structure, and may be a structure for holding the leading end portion of the sheet P by using an air suction force.

For example, the circulating member, which is a chain in the exemplary embodiments described above, is not limited to a chain. For example, the circulating member may be a belt.

The configuration of the image forming apparatus is not limited to those of the exemplary embodiments described above, and may be any appropriate configuration. Moreover, the present disclosure may be carried out in any appropriate mode within the spirit and scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a circulating member that is a part of a transport path that transports a recording medium;

a holding member that is fixed to the circulating member, circulates, and holds a leading end portion of the recording medium;

an image forming section that forms an image on the recording medium at an image forming position in a circulation path of the circulating member; and a feeding section that feeds out the recording medium to a holding position where the holding member holds the leading end portion of the recording medium, wherein, when a circulation velocity Vg is defined as a velocity at which the circulating member circulates the holding member, a transport velocity of the recording medium is reduced from a first transport velocity V1, which is higher than the circulation velocity Vg, to a second transport velocity V2, which is lower than the first transport velocity V1, before the leading end portion of the recording medium enters the holding position.

2. The image forming apparatus according to claim 1, wherein, when an intermediate transport velocity Vc is defined as a transport velocity between the first transport velocity V1 and the second transport velocity V2, the feeding section starts to decelerate the recording medium from the intermediate transport velocity Vc to the second transport velocity V2 at a preset timing after decelerating the recording medium from the first transport velocity V1 to the intermediate transport velocity Vc and transporting the recording medium at the intermediate transport velocity Vc.

3. The image forming apparatus according to claim 1, wherein a timing at which the recording medium starts to decelerate to the second transport velocity V2 is adjusted so that the leading end portion of the recording medium enters the holding position when the holding member moves to the holding position.

4. The image forming apparatus according to claim 3, wherein the circulating member is wrapped around a rotation member, wherein the holding member includes a plurality of holding members, wherein one of the plurality of holding members that is present in a range where the circulating member is wrapped around the rotation member holds the leading end portion of the recording medium at the holding position, wherein a rotation period of the rotation member is equal to a period of intervals at which the plurality of holding members fixed to the circulating member enter the holding position, and wherein, in a case where a time difference between a period signal detected for each rotation of the rotation member and a pass signal indicating that the leading end portion of the recording medium is detected to have passed a pass position between the feeding section and the holding position is large, the timing at which the recording medium starts to decelerate to the second transport velocity V2 is advanced compared with a case where the time difference is small.

5. The image forming apparatus according to claim 2, wherein the timing at which the recording medium starts to decelerate to the intermediate transport velocity Vc is adjusted so that the leading end portion of the recording medium enters the holding position when the holding member moves to the holding position.

6. The image forming apparatus according to claim 5, wherein the circulating member is wrapped around a rotation member, wherein the holding member includes a plurality of holding members, wherein one of the plurality of holding members that is present in a range where the circulating member is wrapped around the rotation member holds the leading end portion of the recording medium at the holding position, wherein a rotation period of the rotation member is equal to a period of intervals at which the plurality of holding members fixed to the circulating member enter the holding position, and wherein, in a case where a time difference between a period signal detected for each rotation of the rotation member and a pass signal indicating that the leading end portion of the recording medium is detected to have passed a pass position between the feeding section and the holding position is large, the timing at which the recording medium starts to decelerate to the intermediate transport velocity Vc is advanced compared with a case where the time difference is small.

7. The image forming apparatus according to claim 4, wherein the circulating member is a chain, wherein the rotation member is a sprocket around which the chain is wrapped, and wherein a number of teeth of the sprocket coincides with a number of links of the chain between the holding members that are adjacent to each other and fixed to the chain.

8. The image forming apparatus according to claim 6, wherein the circulating member is a chain, wherein the rotation member is a sprocket around which the chain is wrapped, and wherein a number of teeth of the sprocket coincides with a number of links of the chain between the holding members that are adjacent to each other and fixed to the chain.

9. The image forming apparatus according to claim 1, wherein a time interval between a time when the recording medium starts to decelerate and a time when the transport velocity of the recording medium reaches the second transport velocity V2 is constant.

10. The image forming apparatus according to claim 9, wherein the time interval between the time when the recording medium starts to decelerate and the time when the transport velocity of the recording medium reaches the second transport velocity V2 is set so that the recording medium finishes decelerating before the leading end portion of the recording medium enters the holding position.

11. The image forming apparatus according to claim 1, wherein the recording medium finishes decelerating to the second transport velocity V2 before the leading end portion of the recording medium enters the holding position.

12. The image forming apparatus according to claim 2, wherein the recording medium finishes decelerating to the second transport velocity V2 before the leading end portion of the recording medium enters the holding position.

13. The image forming apparatus according to claim 3, wherein the recording medium finishes decelerating to the second transport velocity V2 before the leading end portion of the recording medium enters the holding position.

14. The image forming apparatus according to claim 4, wherein the recording medium finishes decelerating to the second transport velocity V2 before the leading end portion of the recording medium enters the holding position.

15. The image forming apparatus according to claim 5, wherein the recording medium finishes decelerating to the second transport velocity V2 before the leading end portion of the recording medium enters the holding position.

16. The image forming apparatus according to claim 6, wherein the recording medium finishes decelerating to the second transport velocity V2 before the leading end portion of the recording medium enters the holding position.

17. The image forming apparatus according to claim 7, wherein the recording medium finishes decelerating to the second transport velocity V2 before the leading end portion of the recording medium enters the holding position.

18. The image forming apparatus according to claim 8, wherein the recording medium finishes decelerating to the second transport velocity V2 before the leading end portion of the recording medium enters the holding position.

19. The image forming apparatus according to claim 9, wherein the recording medium finishes decelerating to the second transport velocity V2 before the leading end portion of the recording medium enters the holding position.

20. An image forming apparatus comprising:

a circulating member that is a part of a transport path that transports a recording medium;

a holding member that is fixed to the circulating member, circulates, and holds a leading end portion of the recording medium;

an image forming section that forms an image on the recording medium at an image forming position in a circulation path of the circulating member; and a feeding section that feeds out the recording medium to a holding position where the holding member holds the leading end portion of the recording medium, wherein the feeding section feeds out the recording medium at a velocity higher than a velocity at which the circulating member circulates the holding member, and wherein a transport velocity of the recording medium is reduced after the leading end portion of the recording medium has entered into the holding member.

* * * * *